United States Patent [19]

von Petery

[11] 4,297,083

[45] Oct. 27, 1981

[54] POSITIVE CONTROL SYSTEM FOR PISTON COMPRESSOR VALVES

[75] Inventor: Curt von Petery, Denkendorf, Fed. Rep. of Germany

[73] Assignee: Gutehoffnungshütte Sterkrade A.G., Oberhausen, Fed. Rep. of Germany

[21] Appl. No.: 91,951

[22] Filed: Nov. 7, 1979

[30] Foreign Application Priority Data

Nov. 11, 1978 [DE] Fed. Rep. of Germany ..... 2849048

[51] Int. Cl.[3] ..... F04B 39/08

[52] U.S. Cl. ..... 417/53; 417/282; 417/505

[58] Field of Search ..... 417/282, 297, 298, 505, 417/53; 137/487, 487.5

[56] References Cited

U.S. PATENT DOCUMENTS 3,494,290 2/1970 Schaible ..... 417/505 X 4,150,925 4/1979 Perkins ..... 417/505 X

*Primary Examiner*—Richard E. Gluck

*Attorney, Agent, or Firm*—Toren, McGeady & Stanger

[57] ABSTRACT

In the positive control of piston compressor valves, during the suction stroke the pressure is sensed in the suction/compression space and the suction line and during the compression stroke the pressure is sensed in the suction/compression space and the delivery line with signals generated by the sensors being transmitted to a comparator unit. The comparator unit is connected to a control unit. Based on the signal sent to the comparator unit and the rated value for the operation of the compressor, signals are sent from the comparator unit to the control unit and, in turn, the control unit selectively regulates the suction valve and the delivery valve of the compressor.

2 Claims, 1 Drawing Figure

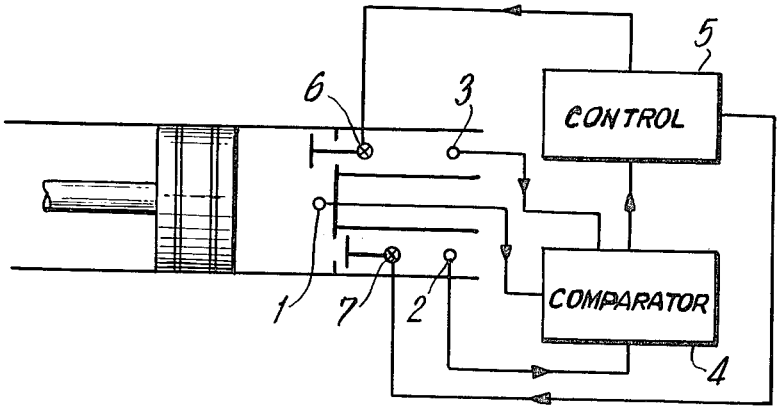
5
6
3
CONTROL
1
7
2
COMPARATOR
4

POSITIVE CONTROL SYSTEM FOR PISTON COMPRESSOR VALVES

SUMMARY OF THE INVENTION

The present invention is directed to a positive or forced control system for the suction and delivery valves of a piston compressor.

Basically, the positive control of valves is known in the art. In engine manufacture, valves are controlled either mechanically or mechanically and hydraulically. If traction is applied to an internal combustion engine it operates as a compressor and conceivably the known design of positive control systems for the valves of the engine could be applied to compressors. The known type of valve control systems, however, could not be used for compressors without encountering problems, such as output control, that is, flow velocity control, variations in the suction and delivery steps of the compressor, and in the composition of the compressed gas.

For these reasons and for the difficulties unavoidably related to them which would be very expense to eliminate, such control systems have not been employed in compressor design. Furthermore, it should be noted that a mechanically operated positive control of valves is of a rigid type. To avoid excessive compression and/or negative pressure and the extremely low efficiencies that result, the opening and closing of the compressor valves must be variable as a function of the pressures in the piston cylinder and in the lines connected to the cylinder. Some of the different situations that must be controlled involve the start-up of the compressor and the variations in operating pressures.

A completely mechanical control system is extremely expensive. A completely hydraulic or pneumatic valve control system without any mechanically operated parts would be inconceivable. While an entirely electrical system is possible, its use would be questionable because of certain of the above requirements.

The most effective positive control system for piston compressor valves seems to be a combination of a mechanical, hydraulic and electrical system or a mechanical, pneumatic and electrical system. Pneumatic, electrical or hydraulic systems are not capable, by themselves, of opening and closing the valves.

In view of the control requirements and the above possible control systems, it is the primary object of the present invention to provide a positive control system for piston compressor valves which meet the above requirements and afford control as a function of the state of the thermodynamic flow media.

In accordance with the present invention, pressure compensation is used and the valve control system of the present invention is characterized in that during the compression stroke, a pressure sensor in the space in the piston cylinder is combined with a pressure sensor in the delivery line, and during the suction stroke a pressure sensor in the cylinder space is coupled with a pressure sensor in the suction line and the pressures sensed are changed into signals which are conveyed to a rated value comparator unit. In the comparator unit the differential pressure $\Delta p$ effective between the cylinder pressure and the associated line pressure is compared and depending on the pressure ratings and the rated value, the valves are selectively regulated, that is, they are opened or closed by hydraulic, pneumatic or electrical controls.

The system meets all of the requirements for valve control of piston compressors. A particular advantage of the system embodying the present invention is its simplicity. The system is adapted to all of the thermodynamic states of the flow medium, it is independent of the pressure heads and the type of gas, and can be used to provide regulation in the range of 0% to 100% volumetric flow without any problem. The assembly of the control system instrumentation is very simple, because the pressure sensors require only electrical lines.

For the pressure sensors various prior art instruments are usable, such as piezo pressure sensors, DMS (strain gauge) based pressure sensors or similar elements, which convert pressure to an analogous signal. In each case the range of the pressure sensors is adaptable to the pressure range of the compressor.

In the system embodying the present invention, the rated or theoretical value comparator unit is multi-functional:

1. The unit compares the analog signals supplied from the pressure sensors. During the compression stroke the signals emanate from the sensor in the cylinder where the compression stroke is effected and from the delivery line from the cylinder. If the signal level is equal or approximately equal, then the pressures in the cylinder and the delivery line are equal or approximately equal, and the rated value comparator unit triggers a pulse which, in turn, drives a control unit, and the control unit, in turn, opens the delivery valve.

2. Subsequently, if the signals originating from the sensors differ from one another by a specific value, then the delivery valve is closed via the rated value comparator unit and the control unit.

3. The steps in 1. and 2. are performed during the compression stroke, accordingly, when the suction stroke is effective the sensor from the delivery line is disconnected from the comparator unit and the sensor from the suction line is connected to the comparator unit so that signals are directed to the unit conveying the pressure status in the cylinder during the suction stroke and also in the suction line.

With this changeover in the signals transmitted to the comparator unit, steps 1. 2. and 3. are repeated with the control of the suction valve being effected.

In the scope of the control system in accordance with the present invention, the hydraulic actuation of the valve appears to be most practical. Pneumatic, electrical and in certain instances mechanical actuations of the valve can be used and in specific exceptional cases (for explosion protection, dry-running compressors, and the like) may be necessary. Conventional instrumentation can be used for the valve actuators.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there are illustrated and described the preferred embodiment of the invention.

BRIEF DESCRIPTION OF THE DRAWING

In the drawing a schematic showing is provided of a system for controlling piston compressor valves in accordance with the present invention.

DETAIL DESCRIPTION OF THE INVENTION

In the drawing the left-hand side of the schematic showing indicates the suction/compression space in the cylinder of a piston compressor. A pressure sensor 1 is located within this space. The pressure sensor 1 is an instrument which converts pressure to an analogous signal.

Additionally, a pressure sensor 2 is located in the delivery line from the cylinder space and another pressure sensor 3 is located in the suction line leading into the cylinder space. During the compression stroke of the piston within the cylinder space, the pressure sensors 1, 2 are connected to a rated or desired value comparator unit 4. The unit simultaneously forms a matching value of the differential pressure $\Delta p$ which is effective between the cylinder space and the delivery line connected to it. If the differential pressure $\Delta p$ is equal to or approximately zero, then the comparator unit 4 triggers a pulse conveyed to a control unit 5 which actuates the control unit and opens delivery valve 7 located in the delivery line. Control of the valve can be carried out, for example, by hydraulic means.

Subsequently, if the signals provided by the pressure sensor 1 in the cylinder space and the pressure sensor 2 in the delivery line differ from one another by a specific value, then the delivery valve 7 is closed via the rated value comparator unit 4 and the control unit 5. In this system it is possible that the pressure sensors 1 and 2 can be disconnected from the comparator unit with the pressure sensors 1 and 3 being connected to the unit and this changeover can be effected by a pulse generated by the location of the piston in the cylinder or by the angle of rotation of the crankshaft with the signal being introduced into the comparator unit 4 as an additional input signal.

With the pressure sensors 1, 2 separated from the comparator unit and with the suction stroke being effective in the cylinder space, the pressure sensors 1, 3 are connected to the comparator unit 4.

In this condition of the control system, if the signals from the pressure sensors 1, 3 are equal or approximately equal, then the pressures within the cylinder space and the suction line are equal or approximately equal, and the comparator unit generates a pulse which actuates the control unit which, in turn, opens the suction valve 6.

Further operation of the control system repeats the above steps as the piston compressor operates through its suction and compression strokes.

While specific embodiments of the invention have been shown and described in detail to illustrate the application of the inventive principles, it will be understood that the invention may be embodied otherwise without departing from such principles.

What is claimed is:

1. Positive control system for opening and closing piston compressor valves comprising a piston compressor including a cylinder forming a suction-compression space, a piston reciprocally mounted in said space for alternately effecting a suction stroke and a compression stroke, a suction line for supplying gas into said space, a delivery line for conveying gas out of said space, a suction valve in said suction line, and a delivery valve in said delivery line, wherein the improvement comprises a rated value comparator unit, a first pressure sensor located in said space and connected to said comparator unit, a second pressure sensor located in said delivery line and separated from said space by said delivery valve, said second pressure sensor being connectible to said comparator unit during the compression stroke of said piston, a third pressure sensor located in said suction line and separated from said space by said suction valve, said third pressure sensor being connectible to said comparator unit during the suction stroke of said piston, a control unit, a conduit connecting said comparator unit and said control unit, a first control line extending between said control unit and said delivery valve, a second control line extending between said control unit and said suction valve, so that during the suction stroke said first and third pressure sensors convey signals to said comparator unit and based on the differential in pressure sensed and rated differential value said comparator unit conveys a signal to said control unit for selectively opening said suction valve when the differential pressure is equal or approximately equal to zero and for selectively closing said suction valve when the differential pressure varies by a specific value, and during the delivery stroke said first and second pressure sensors convey signals to said comparator unit and based on the differential in pressure sensed and a rated differential value said comparator unit conveys a signal to said control unit for selectively opening said delivery valve when the differential pressure is equal or approximately equal to zero and for selectively closing said delivery valve when the differential pressure varies by a specific value.

2. A method of positively controlling the opening and closing of piston compressor valves including a cylinder forming a suction-compression space, a piston reciprocally mounted in the suction-compression space, a suction line connected to the space, a delivery line connected to the space, a suction valve in the suction line, and a delivery valve in the delivery line, wherein the method comprises the steps of sensing the pressure in the suction-compression space and during the suction stroke sensing the pressure in the suction line at a location separated from the suction-compression space by the suction valve and during the compression stroke sensing the pressure in the delivery line at a location separated from the suction-compression space by the delivery valve, conveying the pressures sensed in the suction-compression space and the suction line during the suction stroke to a unit, comparing the pressures sensed in the unit with a rated value and in consideration of the comparison selectively regulating the opening and closing of the suction valve, and conveying the pressures sensed in the suction-compression space and the delivery line during the compression stroke to the unit and comparing the pressures sensed in the unit with a rated value and in consideration of the comparison selectively regulating the opening and closing of the delivery valve.

* * * * *